United States Patent [19]

Rodriguez

[11] Patent Number: 5,024,360

[45] Date of Patent: Jun. 18, 1991

[54] VEST OR LIKE ARTICLE OF CLOTHING FOR CARRYING RECHARGEABLE BATTERIES

[76] Inventor: Norton Rodriguez, 8782 SW. 12th St., #102, Miami, Fla. 33174

[21] Appl. No.: 461,395

[22] Filed: Jan. 5, 1990

[51] Int. Cl.[5] ..... A45F 3/04; A41D 1/00

[52] U.S. Cl. ..... 224/215; 224/902; 2/94

[58] Field of Search ..... 2/94–95, 2/102, 247, 248; 224/902, 215, 209, 202, 224, 227, 211, 262, 203, 204, 214, 316, 250, 223, 228, 240, 908; 128/201.27, 201.29, 202.14; 405/185, 186, 187; 362/103, 108

[56] References Cited

U.S. PATENT DOCUMENTS 3,919,615 11/1975 Niecke ..... 224/226

FOREIGN PATENT DOCUMENTS 125992 7/1949 Sweden ..... 224/214

*Primary Examiner*—Henry J. Recla
*Assistant Examiner*—David J. Walczak
*Attorney, Agent, or Firm*—Malloy, Downey & Malloy

[57] ABSTRACT

An article of clothing, primarily structured as a vest and designed to house a plurality of electrical batteries in a number of different pockets each secured to and mounted on an outer surface of the clothing article and further wherein an electrical conductor is mounted primarily on the interior of the article of clothing in connection with the interior of each of the plurality of chambers as well as the batteries therein. The vest or like article of clothing being structured for support about the shoulders and waist of the wearer to facilitate support and carrying of the batteries with less stress being placed on the wearer.

17 Claims, 3 Drawing Sheets

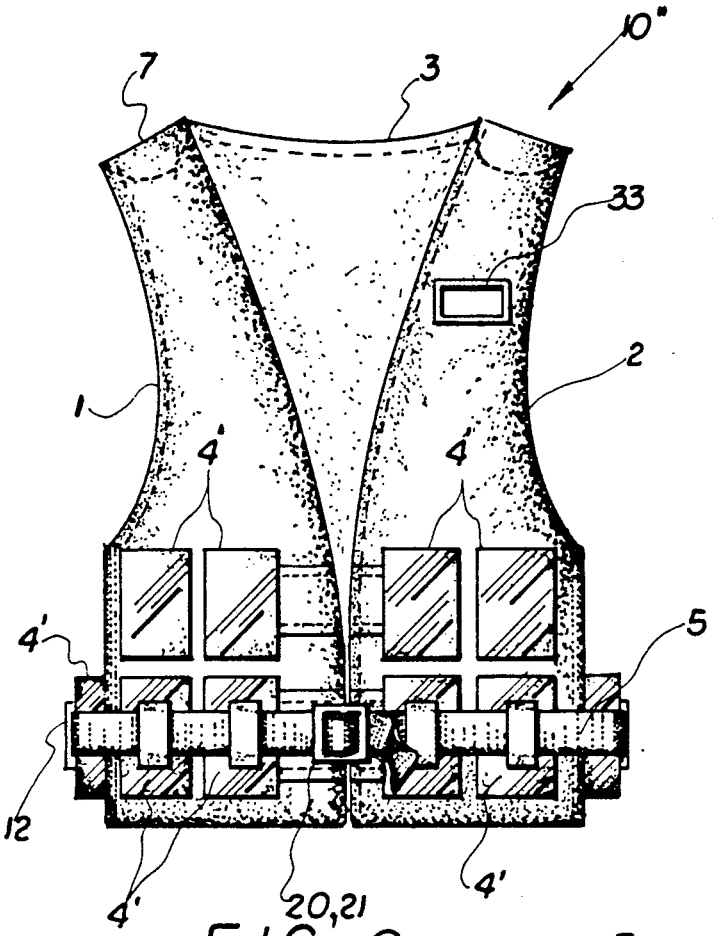
FIG. 6
FIG. 7
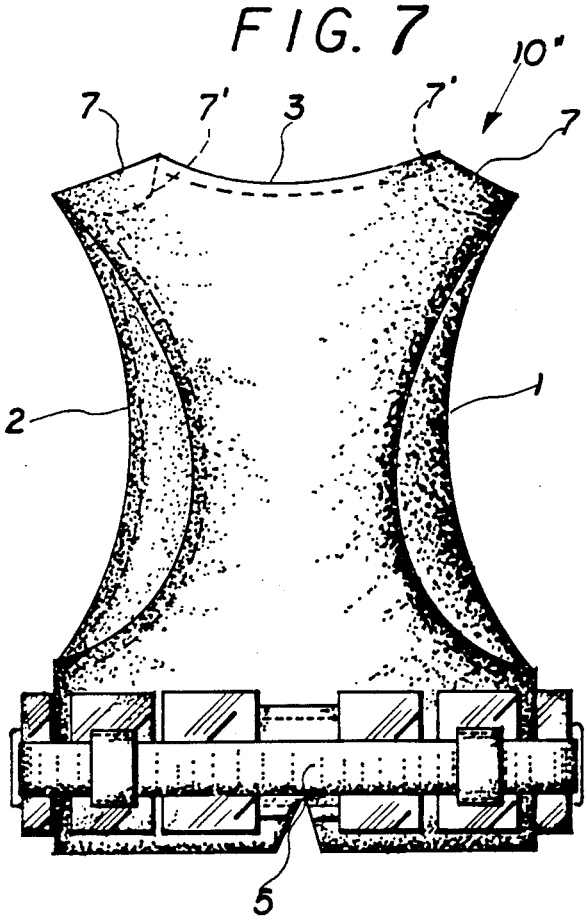

VEST OR LIKE ARTICLE OF CLOTHING FOR CARRYING RECHARGEABLE BATTERIES

BACKGROUND OF THE INVENTION

1. Field of the Invention

This invention relates to a vest like structure or like article of clothing designed to fit on and be supported by the upper portion of a wearer's body and also, specifically structured to removably contain and support a plurality of electrical batteries for defining a portable source of electrical power of the type used with video, photographic, radio, lighting and like equipment or systems.

2. Description of the Prior Art

When a person is using certain types of equipment, such as video systems, lighting equipment and the like, it is common practice to carry on their bodies a portable source of electrical power primarily defined by a plurality of batteries. Typically, such batteries are mounted on a belt-like structure and fitted in conventional fashion about the waist of a wearer or user.

The prior art is demonstrated in the following U.S. Pat. Nos. U.S. Pat. No. 4,108,341 discloses a carrying belt for objects comprising several compartments on a protective cover of synthetic plastic material supported by a belt of synthetic plastic material having a buckle and closure tongue. U.S. Pat. No. 4,106,121 discloses a tactical load bearing vest designed to carry supplies necessary to soldiers in operating certain military operations or the like.

An infiltrator vest is shown in U.S. Pat. No. 3,529,307 which is designed to carry equipment necessary to survival in combat. Similarly, a pack carrier is disclosed in U.S. Pat. No. 3,114,486. This load carrying device is in the form of a corset like harness or frame assembly which places the stress of the load generally in the area of the hips or the like.

A utility vest is shown in U.S. Pat. No. 4,369,526. This vest type structure is designed with pouches of various shapes and sizes to hold various occupational tools and is not related to the maintenance, supply or carrying of a portable electrical current or power supply.

A pack vest is shown in U.S. Pat. No. 4,669,127 and is structured to define a utility garment for load portage in the shape of a vest containing load carrying compartments on the back and front flaps of the vest.

A vest like structure for photographer is shown in U.S. Pat. No. 4,241,459. This vest structure includes a plurality of pockets for carrying various types of photographic equipment or the like.

While all of the above set forth structures as disclosed in the above-noted patents are assumed to be operable for their intended function, none disclose an article of clothing or vest type structure specifically designed to carry and support a portable electrical power source in the form of rechargeable batteries which offers a maximum portable amp hour capability while eliminating generally stress to the lower back, hip and like portions of the wearer's body.

SUMMARY OF THE INVENTION

The present invention is directed towards a vest or similar article of clothing specifically designed to be used to carry a portable electric power source in the form of a plurality of batteries. While the present invention is directed to the structure of the article of clothing or vest and its specific components, such invention will be described for use in combination with a plurality of batteries which may be rechargeable. Further, it should be noted that the vest itself may be structured to support a battery charger therein as well as means to connect the batteries to any one of a plurality of loads such as the various photographic, video or lighting equipment with which such batteries are commonly used.

The article of clothing comprises both a rear portion and a front portion respectively designed to cover the back and frontal portions of the wearer. Such front and back portions are attached and interconnected to one another in the area of the shoulders. Such shoulder portions of what may be considered the main base of the vest like structure overlie the shoulders and serve as a means of support in removing the force and weight of the batteries from other portions of the user's body. Openings are obviously provided on the base for placement about the head and neck of the wearer. In addition, the arms adjacent the shoulder area may protrude outwardly from between the front and rear portions and ample room is provided for the outward extension or protrusion of the arms of the user in order to provide freedom of movement.

An important feature of the present invention is the provision of a plurality of chambers formed generally about the exterior surfaces of the vest and disposed in spaced, somewhat consecutive relation to one another in surrounding relation to what may be referred to as a waist portion of the vest. The waist portion therefore is disposed in surrounding relation to the waist portion of the wearer generally in the area where a normal belt would be placed in conventional clothing. Each of the chambers has a primarily hollow interior and is dimensioned and configured to removably contain therein a plurality of batteries of the type used for the above-noted equipment. As set forth above, such batteries may in fact be rechargeable. An access opening is formed in each of the chambers and may include a closure structure for securing such opening in a closed position. The opening of course may be dimensioned to allow passage of the batteries therethrough so that such batteries may be positioned into and out of their operative position on the interior of each of the chambers.

A retaining means in the form of an elongated belt is structured to include a sufficient longitudinal dimension to attach to each of the chambers generally about an outer face thereof and in somewhat surrounding relation to the chambers, the batteries therein and the waist portion of the base of the vest.

Another important feature of the present invention is the existence of an elongated pocket formed generally on the interior of the vest structure preferably about the waist. This elongated pocket is specifically structured and dimensioned to house an elongated electrical conductor means therein. Such electrical conductor means communicates and is attached to each of the batteries on the interior of each of the respective pockets for interconnection of these batteries to one another and to a load source such as one of the types of equipment as mentioned above.

Other structural features of the article of clothing or vest like structure may include adjustment means for adjusting the size of the vest relative to a user's body. Further, the plurality of chambers may be formed either from a flexible material substantially similar to that from which the vest is formed or alternately, may be formed of a somewhat semi at least partially rigid material having a face plate which is openable to expose the interior thereof and any batteries contained therein.

BRIEF DESCRIPTION OF THE DRAWINGS

For a fuller understanding of the nature of the present invention, reference should be had to the following detailed description taken in connection with the accompanying drawings in which:

FIG. 6 is a front view of yet another embodiment of the present invention.

FIG. 7 is a rear view of the embodiment of FIG. 6.

Like reference numerals refer to like parts throughout the several views of the drawings.

DETAILED DESCRIPTION OF THE PREFERRED EMBODIMENT

Figure 1:
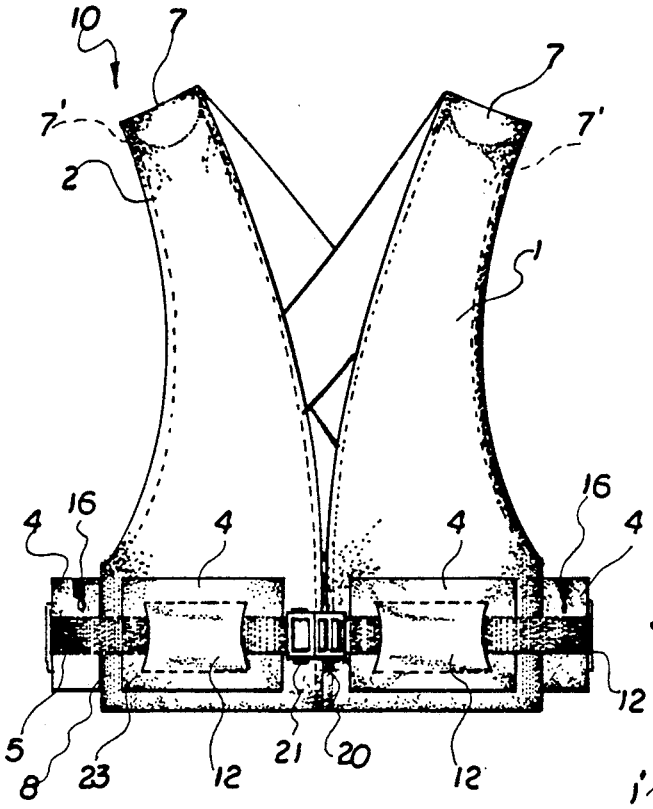
FIG. 1 is a front view of one preferred embodiment of the present invention.
Figure 2:
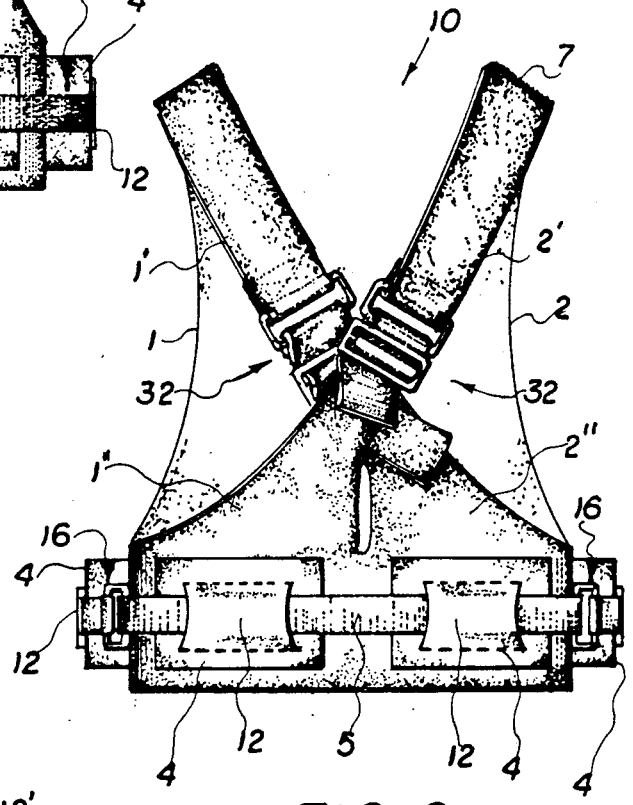
FIG. 2 is a rear view of the embodiment of FIG. 1.
Figure 3:
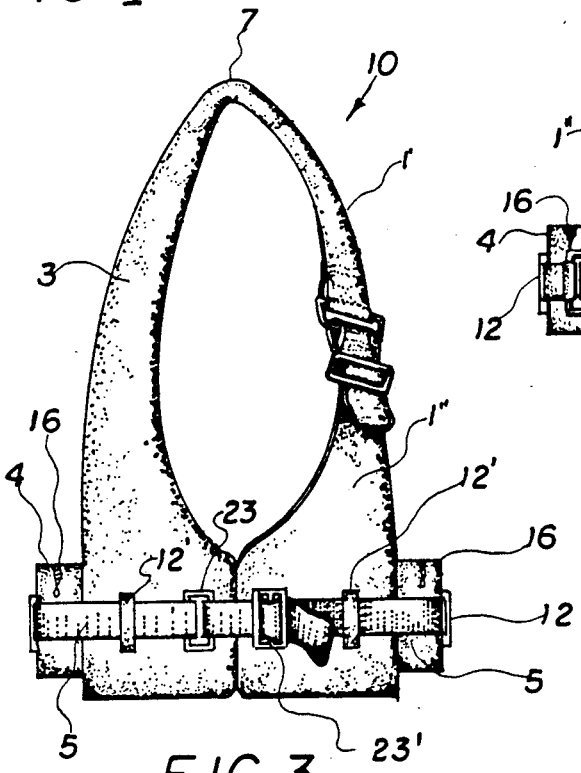
FIG. 3 is a side view of the embodiment of FIGS. 1 and 2.

As shown in FIGS. 1 through 3, one preferred embodiment of the present invention is generally indicated as 10 and comprises a vest like structure defined by a front portion including a first and second front panel 1 and 2 and a rear portion defined by two attachable and adjustably connected panel segments 1' and 1'' and 2' and 2''. More specifically, a cross over type structure is defined wherein the panel segment 1' is adjustably connected to the panel segment 2'' and the panel segment 2' is adjustably connected to the panel segment 1'' (see FIGS. 2 and 3). Each of the aforementioned segments are interconnected to one another by a size adjustment means 32 in the form of an adjustable buckle or the like such that the length of the segments 1', 2'' and 2', 1'' may be adjusted relative to one another to adapt the vest structure 10' to the height and overall size of the user or wearer. Further, the underneath of each shoulder portion 7 includes a padding as at 7' which is designed to add support and comfort to the user's body. The support of the weight of the vest structure 10 as well as the plurality of batteries 14 contained thereon is aided by the overlying supporting engagement of the shoulders 7 with the shoulders of the user. In the embodiment shown in FIG. 1, a plurality of pockets 4 are formed on the exterior surface of the panels 1 and 2 and on the exterior surface of the back panel 3 in substantially spaced apart but consecutive relation to one another generally about a waist area 8 of the vest portion.

A retaining means in the form of an elongated belt 5 is secured in surrounding relation to the waist portion 8 of the base of the vest 10 and also, by virtue of this position in surrounding relation generally about the waist of the wearer, or user of the vest. The belt 5 is attached to the vest by passing through an attachment means in the form of a plurality of loop like structures 12 formed on and at least partially defining an outer surface or face of each of the chambers 4.

Figure 5:
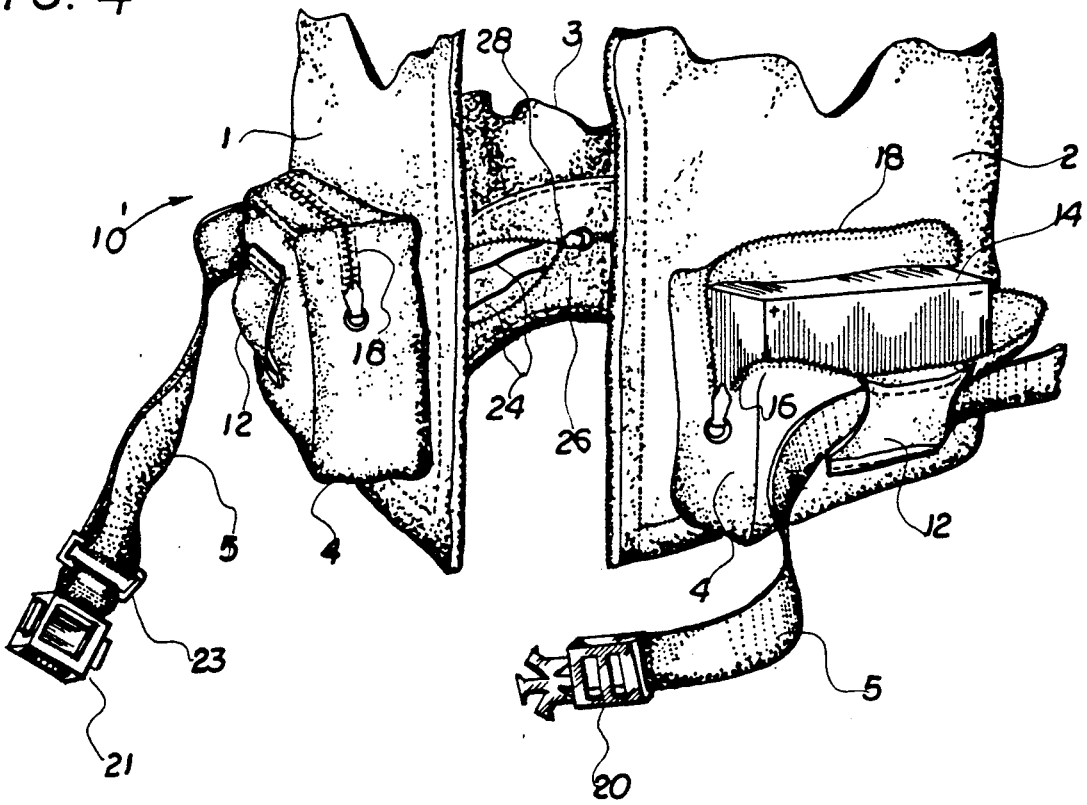
FIG. 5 is a perspective view in partial cut-away showing both exterior and interior details of a preferred embodiment of the present invention.

With reference to FIG. 5, each of the chambers 4 has a hollow interior and an access opening 16 which is dimensioned and configured to allow passage of a battery 14 therethrough. The battery can therefore be easily removed from or positioned operatively within each of the interiors of the chambers 4. A closure means in the form of any type of applicable closure such as but not limited to a zipper 18 connected to the opening 16 and is structured to provide selective opening and closing thereof to provide access to the interior of the chambers 4 and batteries 14 therein.

As further evidenced in FIG. 5 and FIGS. 1 and 3, the free ends of the belt 5 defining the retaining means includes a buckle as at 20 and 21 designed for removable interconnection to one another. Further, an adjustment member as at 23 may be disposed and structured on the belt 5 to regulate the length thereof. In the embodiment of FIGS. 1 and 3, the adjustment means is located on the side and includes an adjustment member 23 and cooperatively disposed adjustment buckle 23'. When the batteries are positioned in their operative position as indicated in FIG. 5, the belt 5 may be tightened about the outer portion of the chambers 4 thereby serving to stabilize the batteries within the chamber and provide a tight fit of the vest 10 about the waist of the user or wearer.

Another important feature evident in FIG. 5 includes the provision of electrical conductor means 24 in the form of one or more electrical conductive wires housed within and extending along the length of an interior pocket 26 which also may have a zipper or any applicable closure as at 28. The electrical conductors 24 are disposed to connect into the interior of each of the pockets 26 preferably through a rear panel or portion thereof and therefore provide electrical current to each of the batteries 14 maintained within the respective pockets. It should be apparent therefore that the electrical conductor means 24 as well as the elongated pocket 26 effectively pass in surrounding relation about the waist of the user and is attached generally to the waist portion of the base or vest in order to interconnect the various batteries to one another as well as interconnect the batteries to a load such as any type of applicable equipment or system whether it be video, photographic or lighting equipment.

The embodiments of FIGS. 1 through 5 are formed from a water resistant, substantially flexible material and the chambers 4 are also formed from a similar type material specifically being water resistant so as to protect the batteries maintained on the interior therein. Such material from which both the vest and the chambers are formed is substantially flexible and clothlike in nature.

Figure 4:
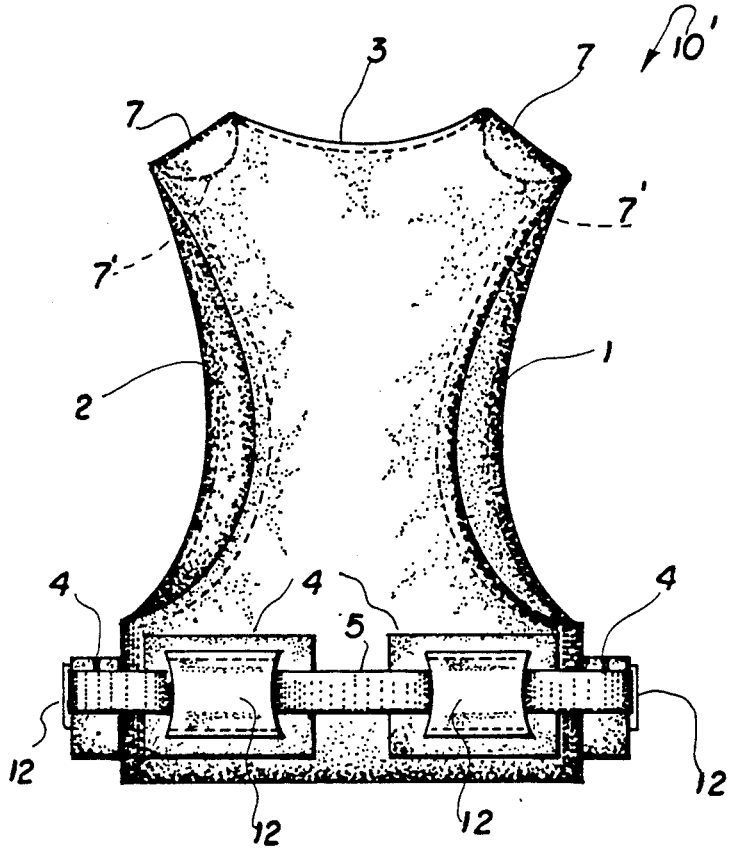
FIG. 4 is a rear view of another embodiment of the subject invention.

As shown in FIG. 6 and 7, the embodiment represented generally as 10'' includes similarly structured front and back portions as that of the embodiment of FIGS. 4 and 5 but differs therefrom by including a plurality of chambers 4' each designed to hold a rechargeable battery structure therein wherein the chambers 4' are formed of a substantially rigid material having a front panel or like which is removable to expose the interior and any battery contained therein. Further, a first or lower row of chambers 4' is surrounded by a retaining means in the form of the same belt 5 connected to a front portion of the vest structure 10'' by a conventional buckle or the like 20, 21. However, an upper or second row of chambers 4' may be secured to the outer surface of each of the panels 1 and 2 on the front of the vest structure 10''. As shown in FIG. 7, the rear or back of the embodiment shown in FIG. 6 is absent any type of second row of chambers 4'. Also, the upper row of chambers 4' does not have any retaining or stabilizing belt 5 disposed over the exterior surface thereof.

An ID badge or supporting structure as at 33 may be mounted on the front portion of the vest structure 10" as shown in FIG. 6.

Now that the invention has been described,

What is claimed is:

1. An article of clothing designed for the support of a plurality of batteries about an upper portion of a person's body, said article comprising:

a base including a front portion and a rear portion each respectively dimensioned and configured to substantially cover an upper, frontal portion and an upper, rear portion of the user's body, said front portion of said base including two front panels each joined to a separate one of two rear panels of said rear portion at corresponding upper ends to define shoulder portions disposed to overlie and be supported over a substantial surface of the shoulders of the user so as to equally distribute a load thereon, said base further comprising a waist portion disposed in overlying and at least partially surrounding relation to a waist of the user, a plurality of chambers mounted on an exterior of adjustable stabilizing means mounted on the exterior of said base in a substantially surrounding relation to said chambers and said waist portion thereof and structured and disposed for stabilizing the batteries within said plurality of chambers so as to prevent excessive movement of the batteries relative to the waist of the user and for selectively altering the size of said base relative to the waist portion of a wearer, adjustment means on said base structured and disposed for selectively altering the length of said front and said rear panels relative to the length of the upper portion of the user's body, and plurality of batteries to be disposed within said chambers and a load to the batteries.

2. An article as in claim 1 wherein each of said chambers are connected to and extend outwardly from exterior surface portions of both said front and rear portions.

3. An article as in claim 2 wherein said plurality of chambers are disposed in successive, spaced relation and collectively in surrounding relation to the user.

4. An article as in claim 1 wherein said stabilizing means comprises a belt having an elongated dimension of sufficient length to surround said waist portion of said base and being mounted to said plurality of chambers.

5. An article as in claim 4 further comprising attachment means mounted on an exterior of said plurality of chambers and structured to support said belt thereon.

6. An article as in claim 5 wherein said attachment means comprises a loop structure formed on an outer face of each of said chambers and configured to supportingly attach said belt consecutively to each of said plurality of chambers.

7. An article as in claim 1 wherein said stabilizing means comprises a belt having an elongated dimension of sufficient length to surround said waist portion of said base and being mounted to said plurality of chambers.

8. An article as in claim 7 further comprising attachment means mounted on an exterior of said plurality of chambers and structured to support said belt thereon.

9. An article as in claim 8 wherein said attachment means comprises a loop structure formed on an outer face of each of said chambers and configured to supportingly attach said belt consecutively to each of said plurality of chambers.

10. An article as in claim 1 further comprising an elongated pocket mounted on an interior portion of said base and extending about a waist portion of said base, said pocket dimensioned and configured to house said electrical conductor means therein.

11. An article as in claim 10 wherein said pocket comprises an opening means extending along a length thereof and structured to be selectively opened and closed to provide access to an interior thereof and said electrical conductor therein.

12. An article as in claim 10 wherein each of said chambers are structured to receive said electrical conductor means therein in attachment to a battery contained therein.

13. An article as in claim 1 wherein each of said chambers are structured to receive an electrical conductor means therein in attachment to a battery contained therein.

14. An article as in claim 1 wherein said plurality of chambers are formed of a flexible material and are secured to said stabilizing means about an exterior portion thereof and the batteries therein are stabilized by said stabilizing means.

15. An article as in claim 1 wherein said front panels are disposed in spaced, side-by-side relation to one another and said rear panels are disposed in crossed, overlapping relation to one another.

16. An article as in claim 1 wherein said adjustment means comprises two separate adjustment structures each mounted on one of said rear panels and structured and disposed to allow adjustment of the length thereof relative to the user's upper body.

17. An article as in claim 1 wherein said shoulder portions each include padding on an underside thereof positioned and disposed to provide added support and comfort to the shoulders of the user.

* * * * *